United States Patent [19]

Dollman et al.

[11] Patent Number: 4,762,638

[45] Date of Patent: Aug. 9, 1988

[54] ALKALINE CLEANER FOR ALUMINUM

[75] Inventors: David Y. Dollman, Doylestown; Stanley L. Blaszczyk, Lansdale, both of Pa.

[73] Assignee: Amchem Products, Inc., Ambler, Pa.

[21] Appl. No.: 73,295

[22] Filed: Jul. 13, 1987

Related U.S. Application Data

[63] Continuation of Ser. No. 853,481, Apr. 23, 1986, abandoned, which is a continuation-in-part of Ser. No. 733,546, May 13, 1985, abandoned.

[51] Int. Cl.[4] ..... C11D 7/06

[52] U.S. Cl. ..... 252/135; 252/156; 252/527; 252/546; 134/2; 134/3; 134/40; 134/41; 156/665

[58] Field of Search ..... 252/156, 527, 546, 135; 134/2, 3, 40, 41; 156/665

[56] References Cited

U.S. PATENT DOCUMENTS

| | | | |
|---|---|---|---|
| 3,888,783 | 6/1975 | Rodzewich | 252/135 |
| 3,969,135 | 7/1976 | King et al. | 134/41 |
| 3,975,215 | 8/1976 | Rodzewich | 148/6.17 |
| 4,009,115 | 2/1977 | Binns | 252/142 |
| 4,093,566 | 6/1978 | MacNamara et al. | 252/135 |
| 4,116,853 | 9/1978 | Binns | 252/142 |
| 4,124,407 | 11/1978 | Binns | 134/3 |
| 4,477,290 | 10/1984 | Carroll et al. | 148/6 |
| 4,540,444 | 9/1985 | Kelly | 134/3 |

FOREIGN PATENT DOCUMENTS

| | | |
|---|---|---|
| 48-103033 | 12/1973 | Japan . |
| 51-149830 | 12/1976 | Japan . |
| 53-149130 | 12/1978 | Japan . |
| 2102838 | 2/1983 | United Kingdom . |

OTHER PUBLICATIONS

Organic Chelating Agents, Thomas A. Downey, Soap and Chemical Specialties, 1966.

*Primary Examiner*—A. Lionel Clingman
*Assistant Examiner*—Hoa Van Le
*Attorney, Agent, or Firm*—Ernest G. Szoke; Henry E. Millson, Jr.; Real J. Grandmaison

[57] ABSTRACT

A cleaning composition bath, concentrate for its preparation, and method of use of an aqueous alkaline cleaner comprising an ethylenediaminetetraacetic acid or nitrilotriacetic acid alkali metal salt, an inorganic alkali metal phosphate, a surfactant and optionally an aluminum sequestrant, other inorganic salts and an alkali metal hydroxide, if needed, to adjust the pH of the composition to at least 11.0.

20 Claims, No Drawings

ALKALINE CLEANER FOR ALUMINUM

This application is a continuation of application Ser. No. 853,481, filed Apr. 23, 1986, which is a continuation-in-part of Ser. No. 733,546 filed on May 13, 1985, both now abandoned.

BACKGROUND OF THE INVENTION

1. Field of the Invention

This invention relates to the cleaning of aluminum surfaces, particularly drawn and ironed aluminum cans containing lubricant contaminants, using an alkaline composition.

2. Statement of the Related Art

Containers of aluminum and aluminum alloys are manufactured by a drawing and forming operation, commonly referred to as drawing and ironing. This operation results in the deposition of lubricant and forming oil contaminants on the surfaces of the container. In addition, residual aluminum fine contaminants are deposited on the surfaces, with relatively larger quantities present on the inside surface of the container.

Prior to processing the containers, e.g. conversion coating and sanitary lacquer deposition, the surfaces of the containers must be clean and free of waterbreaks, so that no contaminants remain on the surfaces which will interfere with further processing of the containers.

Compositions currently used commercially for cleaning such aluminum containers are aqueous sulfuric acid solutions containing hydrofluoric acid and one or more surfactants. Such cleaning solutions are quite effective and have many advantages. However, there are also some disadvantages associated with such acid cleaning compositions. For example, such compositions are capable of dissolving stainless steel and other iron alloy equipment commonly utilized in the container cleaning lines. Also, hydrofluoric acid and fluorides present in spent cleaning baths and rinse water present an environmental problem in their disposition.

Alkaline cleaning solutions have been formulated in the past to try to overcome the above problems, but such alkaline solutions have instead raised new serious problems of their own which have mitigated against their commercial use. For example, when cleaning solutions employing alkali metal hydroxides were tried, extensive and irregular etching of the aluminum containers occurred, rendering the containers commercially unacceptable.

Other alkaline cleaning solutions have also been tried with varying success. For example, U.S. patent application Ser. No. 273,484 and a continuation-in-part thereof, Ser. No. 383,289 disclosed an alkaline cleaner comprising: 0.5 to 3 grams/liter (g/l) of an alkali metal hydroxide (such as NaOH); 1 to 5 g/l of an alkali metal salt of ethylenediaminetetraacetic acid (such as sodium EDTA); 0.1 to 10 g/l of at least one anionic, cationic, or nonionic surfactant (such as an anionic surfactant believed to be composed of two parts of a modified polyethoxylated straight chain alcohol and one part of a linear alkyl succinate, optionally combined with an alkali metal salt of 2-butoxyethoxyacetate); and optionally further containing 0.6 to 1.3 g/l of an aluminum sequestering agent (such as sodium glucoheptonate). It may be noted that the EDTA in this composition does not function as an aluminum sequestering agent, because of the alkaline pH of the composition.

While the compositions of the above applications were excellent aluminum can cleaners, resulting in cans with virtually no waterbreaks, problems arose when a production line was interrupted for any length of time beyond a few minutes. It was found that cans that stood without after rinsing for any length of time developed severe staining, particularly at those points where the cans were in contact with each other. Even the slightest such stain would make the cans unusable, since they appeared blemished, even after subsequent coating. While most can cleaning operations are by spraying with a cleaner for a short time such as 10 to 60 seconds, it was also found that times of 60 to 120 seconds, which are occasionally employed, might also result in staining. Additionally, it was found that where there was an usually large amount of lubricant contaminant, such as more than about 1.5 g/l, the cleaner was less effective.

A number of patents or published patent applications disclose alkaline or neutral cleaning compositions for metal surfaces, including the following:

U.S. Pat. No. 3,975,215—Rodzewich, assigned to Amchem Products, Inc.

U.S. Pat. No. 3,888,783—Rodzewich, assigned to Amchem, Products, Inc.

U.S. Pat. No. 4,093,566, assigned to the United States of America

Japanese No. 53/149,130, assigned to Nihon Parkerizing

Japanese No. 51/149,830, assigned to Matsushita Elc. Ind.

Japanese No. 50/067,726, assigned to Kurita Water Ind.

Japanese No. 48/103,033, assigned to Nittan Co., Ltd.

Prior art acid cleaning composition for cleaning aluminum surfaces are disclosed in U.S. Pat. No. 4,124,407—Binns, U.S. Pat. No. 4,116,853—Binns, U.S. Pat. No. 4,009,115—Binns, and U.S. Pat. No. 3,969,135—King.

U.S. Pat. No. 4,477,290 assigned to Pennwalt, describes an alkaline aluminum cleaner having a minimum amount of 6 g/l of NaOH or KOH, which is far in excess of a desirable amount and will cause smutting. The solutions are stated as having a pH of about 13. Chelating (sequestrant) agents including sorbitol, gluconic acid, and glucoheptoic acid are disclosed. A composition of 0.6 to 2 g/l of tetrapotassium pyrophosphate, 0.5 to 1.8 g/l of sodium gluconate, and 0.5 to 1.8 g/l of KOH is also disclosed, although no EDTA or surfactant is present.

SUMMARY OF THE INVENTION

The invention affords compositions and methods for cleaning aluminum, particularly aluminum cans contaminated with lubricants and other oils, aluminum fines, etc. The compositions are in the nature of both initial cleaners and replenisher cleaners, as well as concentrates used in formulating these cleaners.

The alkaline aluminum-cleaning compositions of this invention are employed in aqueous cleaning baths, whose pH must be 11.0 or higher, preferably in the range 11.0 to 12.5, most preferably 11.5 to 12.3. The compositions may be either in powder-form or in the form of an aqueous concentrate solution. Both powder and aqueous solution may be in a single component package, or may have two or three components.

The ingredients of the inventive compositions comprise the following:

(a) an alkali metal salt of ethylenediaminetetraacetic acid (EDTA) or of nitrilotriacetic acod (NTA) or a combination of these salts; present in the bath in 0.1 to 8.0 g/l (grams per liter), preferably 0.3 to 5.0 g/l, most preferably 1.5 to 3.0 g/l;
(b) at least one surfactant; present in the bath in 0.1 to 10 g/l, preferably 0.2 to 3.0 g/l; and
(c) at least one inorganic alkali metal phosphate; present in the bath in 0.1 to 20 g/l, preferably 2.0 to 10.0 g/l, most preferably 4.0 to 8.0 g/l.

It is usually necessary to raise the pH of the cleaning bath to at least the critical value of 11.0, for which purpose one optionally should include in the powder or aqueous concentrate:

(d) at least one alkali metal hydroxide; present in the bath in an amount necessary to achieve the desired pH of above 11, preferably in an amount of up to 5 g/l.

Further optional ingredients are:

(e) a second inorganic salt; which may be present in the bath in an amount in g/l up to one-half the amount of inorganic alkali metal phosphate (ingredient c) which is present; and/or
(f) a second aluminum sequestering agent (other than ingredient a); which may be present in 0 to 10 g/l, preferably 0.5 to 10 g/l, most preferably 0.6 to 1.3 g/l.

Because the compositions of this invention are used primarily for cleaning aluminum cans in a production line, and in the final form of an aqueous cleaning solution into which the unfinished cans are dipped, or with which they are sprayed, quantities of ingredients are stated in terms of grams per liter of the complete aqueous cleaning solution. Because of the nature of the various composition ingredients, they may be added to the aqueous cleaning bath individually, all at once, or in any combinations.

Where the ingredients are added in their essentially dry (powder) form, they are generally physically compatible with each other, although where a liquid surfactant is used, it may be advantageous to add it separately. Adding powder-form ingredients has the advantage of lighter weight in transportation, since the water is absent. However, powders usually must be premixed with water for ease of addition.

In a preferred embodiment, the ingredients are added in the form of aqueous solutions. Advantages of using such solutions are ease of handling, bulk storage capability, and the avoidance of premixing. The at least one surfactant may tend to separate from the other liquid ingredients, in which instance it simply should be added separately.

Because the pH of the cleaning bath is critical, variations in pH (caused by extraneous factors such as the ambient pH of the bath water) must be capable of adjustment. The easiest way to adjust the pH is by varying the amount of alkali metal hydroxide. For this reason, it generally is advantageous to add the alkali metal hydroxide separately. Thus, a two-component or even three-component composition package is generally advantageous, although a one-component composition package is feasible.

Other than in the operating examples, or where otherwise indicated, all numbers expressing quantities of ingredients, reaction conditions, or defining ingredient parameters used herein are understood as modified in all instances by the term "about".

DETAILED DESCRIPTION OF THE INVENTION

The alkali metal salt of either the ethylenediaminetetraacetic acid or nitrilotriacetic acid is preferably a sodium salt, although potassium and lithium salts can also be employed. The salt is preferably the di-, tri-, or, in the case of ethylenediaminetetraacetic acid the tetra-alkali metal salt, a mixture of such salts can be used. The mono-alkali metal salt can be used, but tends to be somewhat less soluble in the concentrates of the invention. In general, the alkali metal salts of the ethylenediaminetetraacetic acid and the nitrilotriacetic acid can be substituted, one for the other, on a mol per mol basis.

The surfactant can be anionic, cationic or nonionic and combinations of two or more surfactants can be employed. Examples of surfactants that can be used in the cleaning solutions of the present invention are disclosed in columns 6 and 7 of U.S. Pat. No. 4,116,853—Binns.

The following specific surfactants and/or combinations thereof are preferred in the practice of the invention.

(A) nonylphenoxy polyethoxy ethanol (sold by Rohm and Haas Co. under the trademark "Triton" N 100).
(B) a modified polyethoxy adduct (sold by Rohm and Haas Co. under the trademark "Triton" CF 76).
(C) a nonionic believed to be an alkyl polyethoxylated ether (sold by Jefferson Chemical Co. under the trademark "Surfonic" LF 17).
(D) an anionic believed to be comprised of two parts of a modified polyethoxylated straight chain alcohol and one part of a linear alkyl succinate (sold by Rohm and Haas Co. under the trademark "Triton" DF-20).
(E) a nonionic believed to be a modified ethoxylated straight chain alcohol (sold by BASF Wyandotte Corp. under the trademark "Plurafac" D-25).
(F) a nonionic believed to be an ethoxylated abietic acid derivative+15 E.O. (sold by Hercules, Inc. under the trademark "Surfactant AR 150").
(G) a nonionic believed to be a block copolymer of about 90% polyoxypropylene and about 10% polyoxyethylene (sold by BASF Wyandotte Corp. under the trademark "Pluronic" 31R1).
(H) a combination of (D) with an alkali metal salt of 2-butoxyethoxyacetate (preferably sodium, although potassium and lithium may be employed).

Various combinations of the above surfactants (A) through (H) may be used, some of which are preferred. Thus, a combination of (A) and (C) is most preferred, while a preferred combination is (A) and (B). Other useful combinations are (C) and (F), and (H). When any combination of surfactants is employed, it is preferred that each surfactant is present in 0.1 to 5 g/l, in the cleaning solution. A defoamer may also be present.

The above preferred surfactants and surfactant combinations are in fact much preferred for use in the present cleaning solutions based on their ability, particularly when an aluminum sequestering agent is also present, to contribute to preventing discoloration (staining) of those aluminum cans that stand wet with the cleaning solution during periods of line stoppage. It is believed that this is because the surfactants wet the can surfaces sufficiently to prevent the formation of a meniscus between the cans or at least to reduce any such meniscus in size. However, with the inorganic salts according to this invention added to the cleaning solution, the staining problem appears to be obviated regardless of the surfactant.

The second aluminum sequestering agent optionally (but preferably) included in the cleaning solutions of the invention can be any compound known for its ability to sequester aluminum in aqueous alkaline solution. Examples of such compounds include sorbitol, an alkali metal (e.g. sodium) gluconate, an alkali metal (e.g. sodium) glucoheptonate, and an alkali metal (e.g. sodium) tartrate, with sorbitol and sodium glucoheptonate being preferred.

The useful inorganic alkali metal phosphates are sodium tripolyphosphate, sodium pyrophosphate, sodium hexametaphosphate, trisodiumphosphate, sodium phosphate monobasic, and sodium phosphate dibasic as well as corresponding potassium and lithium salts.

Any of the phosphate salts or their combinations, which are critical to this invention, may be used. In descending order of preference, these salts are (a) tripolyphosphates, (b) pyrophosphates, (c) hexametaphosphates or trisodium phosphates, and (d) all of the remaining salts. The sodium salts are always preferred, although the potassium salts and even the lithium salts may also be used.

The second inorganic salts which optionally may be used include sodium carbonate, sodium nitrate, sodium sulfate, sodium aluminate, and corresponding potassium or lithium salts.

The alkali metal hydroxide which is used herein if necessary to adjust the pH of the composition to within the required ranges, may be sodium hydroxide (caustic soda), potassium hydroxide (potash), lithium hydroxide, or their mixture. Sodium hydroxide is preferred. Where potassium hydroxide is used, the amounts of other ingredients may be reduced, although still within the above parameters. It may also be necessary to increase the pH while a production line is running, in order to prevent staining in case of line stoppage. This can be done by titering the hydroxide addition upward, starting from a minimal amount, until acceptably clean cans are obtained. Since the ingredients do not react with each other prior to their cleaning of the aluminum surfaces, they may be added all together, individually, or in any combination. Thus, a preferred concentrate is a two-package combination, the first package containing all ingredients except the alkali metal hydroxide and the second package containing the hydroxide with, optionally, some or all of the inorganic salt. When the cleaning solution is prepared from the concentrate, water is added to the first package so that the various ingredients therein are in the concentration ranges set forth herein and the second package containing the alkali metal hydroxide is dissolved in the water before, after, or simultaneously with the first package if necessary to adjust the pH to at least 11, preferably 11 to 12.5, more preferably 11.5 to 12.3. When it is desired to include all ingredients in a single concentrate package, it may be stirred or shaken just prior to metering a given amount or it may be supplied in containers small enough so that the entire container content is used at once.

The processes of the invention comprise contacting the aluminum or aluminum alloy surfaces to be cleaned with the aqueous cleaning compositions of the invention using any of the contacting techniques known in the art, such as conventional spray or immersion methods, spraying being preferred.

The temperature of the cleaning composition should be maintained within the range 80° to 150° F. (27° to 66° C.), preferably 90° to 140° F. (32° to 60° C.), most preferably 100° to 130° F. (38° to 55° C.).

The treatment time may vary, depending upon the nature of the aluminum production line. Such times are generally 10 to 120 seconds, preferably 10 to 60 seconds.

Following the cleaning step, the aluminum surfaces are rinsed with water to remove the cleaning solution. The aluminum surface may then be treated with coating solutions or siccative finish coating compositions well known to the art. Also, prerinses of the aluminum surfaces with water prior to the cleaning step is sometimes beneficial in reducing the amount of contaminants that would otherwise enter the cleaning bath.

Spent cleaning solutions and rinse waters present few problems in their safe disposition. For example, the alkali metal salts of ethylenediaminetetraacetic acid are readily oxidized to environmentally relatively harmless components by treatment of the spent cleaning solutions with small quantities of peroxides such as hydrogen peroxide. To render any alkali metal hydroxide which is present harmless, water containing hydrochloric acid can be added until a pH of about 7 is obtained.

EXAMPLES

The following examples, although not intended to be limiting, are illustrative of this invention.

In all of the following examples, the alkaline hydroxide was NaOH used in a constant ratio of 1 g/l, the EDTA was sodium EDTA used in a constant ratio of 2.5 g/l, and the aluminum sequestering agent was sodium glucoheptonate and was always present in a ratio of 1 g/l. The inorganic and phosphate salts were varied, as were their amounts. Some tests were run without any salts, for comparison purposes. (See Examples C-1 to C-7) The surfactant used in all of these tests was a combination of 3:5 parts of (A) and (C), although the amounts used were varied. In one comparative test, no surfactant was used and the inorganic salt was sodium tripolyphosphate. While this composition had some utility, the amount of tripolyphosphate had to be increased to the point where it could not be dissolved in the make-up concentrate and therefore had to be added as a separate solution. (see Example 2).

Each of the baths were run in a laboratory carrousel washer with a prewash of water at 145° F. (63° C.) for 30 seconds with a 20 second blow-off and a wash at 135° F. (57° C.) for 15 seconds followed by a 30 second blow-off.

TEST CRITERIA

The tests were all run on two-part 3004 alloy aluminum cans (without tops) which had been drawn and ironed and which were covered with aluminum fines and drawing oils. The cans were treated in circular groupings of fourteen cans, so that each can was in constant contact with at least two other cans.

The percentage of waterbreak free surface (% WFS) was determined as follows. After the cans are treated and washed, they are dipped into a saturated sodium sulfate bath kept at 150° F. (66° C.). After excess water runs off (10 seconds) they are flash dried in an oven at 300° C. Where waterbreak is evident on a can, the surface will be clear of salt (i.e. silver). Where the surface is waterbreak free, it will be covered with a coating of salt, and will appear white. The percentage of white to silver may be determined visually, with an optical scanner, or by any other means. 100% means that the surface is completely white (i.e. waterbreak free). This test is extremely rigorous, and a percentage of at least 70% is needed to be within the scope of this invention, at least 80% being preferred, and at least 90% being most preferred. An acceptable test result means that a can will be waterbreak free for most practical purposes, in a production line.

The stain (blemish) is usually brown and may be measured visually or by a suitable scanning device. Once such device is a "Stain Scanner" which measures the amount of light reflected off a can dome. Light is transmitted by means of optical fibers to a chamber, where it is reflected off a can to a photovoltaic cell. The intensity of the reflected light is proportional to the brightness of the can surface. A millevolt meter is used to measure the output of the photovoltaic cell. The light is adjusted to a standard with a variable rheostat. The standard in this instance is 300 mv. After the cans are washed and allowed to dry, a reflectance measurement is taken. The bath used to treat the can is then poured into the (concave) dome of the can. It is then heated in an oven at 200° C. for 5 minutes. The cans are then rinsed and dried. A second reflectance measurement is then taken and the result compared with the first. The differential (dSS) determines the amount of stain. The result must not be a negative number, which would indicate staining. The most desireable result for stain prevention is 0 or close to 0, indicating little or no change.

Foaming may be a problem with some cleaner compositions. When aluminum cans are sprayed, the residue solution is collected in a tank below the suspended cans. This residue solution is then recirculated to the sprayers, in a continuing operation. An excess of foaming (i.e. over the top of the tank) may result in a loss of treating composition as well as undesireable contamination. The control of foaming is therefore very desireable. To test for foaming a single can washer was used. It was filled with 4 l of cleaning bath solution, and the temperature set at 135° F. (57° C.). The bath was sprayed for the indicated time and the foam level was recorded in liters of foam. After 10 minutes of spraying, the foam was allowed to decay for 10 minutes and the level was again recorded.

EXAMPLES 1-29 (INCLUDING COMPARATIVE)

Sodium tripolyphosphate was used as the nonorganic salt.

TABLE I

| Example | TPP (g/l) | Surfactant (g/l) | % WBF | dSS | Foaming 1 min | 3 min | 5 min | 10 min | 10 min Decay |
|---|---|---|---|---|---|---|---|---|---|
| C-1 | 0 | 1.25 | 23.6 | −23 | .5 | 1.1 | 1.4 | 2.4 | 1.0 |
| C-2 | 0 | 3.75 | 44.5 | −29 | .8 | 1.6 | 2.0 | 2.6 | .8 |
| C-3 | 0 | 6.25 | 60.5 | −36 | 3.4 | * | | | |
| C-4 | 0 | 7.5 | 78.6 | −36 | 5.1 | * | | | |
| C-5 | 0 | 8.75 | 82.9 | −34 | 3.8 | * | | | |
| C-6 | 0 | 12.5 | 73.3 | −36 | 1.8 | 2.9 | 3.6 | 4.1 | .2 |
| C-7 | 0 | 15.0 | 57.7 | −37 | .9 | .5 | .4 | .4 | .1 |
| 8 | 4 | 1.25 | 81.2 | +1 | .5 | 1.0 | 1.2 | 1.8 | .8 |
| 9 | 4 | 2.5 | 89.9 | +1 | 1.1 | 2.1 | 2.6 | 3.1 | .8 |
| 10 | 4 | 5.0 | 88.3 | +2 | 3.8 | * | | | |
| 11 | 4 | 7.5 | 93.9 | +0 | .8 | 2.2 | 2.5 | 2.6 | .2 |
| 12 | 4 | 8.75 | 92.0 | +3 | .4 | 1.2 | 1.6 | 2.0 | .2 |
| 13 | 4 | 10.0 | 90.3 | +1 | .4 | .3 | .3 | .4 | .1 |
| 14 | 4 | 12.5 | 88.3 | +3 | .4 | .2 | .2 | .2 | .1 |
| 15 | 4 | 15.0 | 76.3 | +4 | .2 | .2 | .2 | .2 | 0 |
| 16 | 8 | 1.25 | 84.3 | +8 | .8 | 1.3 | 1.6 | 2.2 | .8 |
| 17 | 8 | 2.5 | 90.5 | +8 | 2.1 | 4.1 | 5.8 | 6.2 | .4 |
| 18 | 8 | 3.75 | 93.6 | +9 | 3.4 | * | | | |
| 19 | 8 | 6.25 | 95.7 | +8 | .2 | .4 | .4 | .4 | 0 |
| 20 | 8 | 8.75 | 92.2 | +6 | .2 | .2 | .2 | .2 | 0 |
| 21 | 8 | 10.0 | 96.5 | +8 | .2 | .2 | .2 | .2 | 0 |
| 22 | 12 | 1.25 | 90.4 | +5 | .7 | 1.5 | 1.7 | 2.8 | .7 |
| 23 | 12 | 2.5 | 93.4 | +7 | 2.6 | 6.3 | # | | |
| 24 | 12 | 5.0 | 93.6 | +5 | .2 | .2 | .2 | .2 | 0 |
| 25 | 12 | 7.5 | 93.5 | +5 | .2 | .2 | .2 | .2 | 0 |
| 26 | 16 | 1.25 | 91.2 | +5 | 1.0 | 2.1 | 2.8 | 3.5 | .4 |
| 27 | 16 | 2.5 | 95.4 | +9 | 2.8 | * | | | |
| 28 | 16 | 5.0 | 94.0 | +9 | .2 | .2 | .2 | .2 | 0 |
| 29 | 20 | 0 | 81.8 | +5 | .5 | .8 | 1.0 | 1.8 | 0 |

*over top at 2 min.
# over top at 4 min.

EXAMPLES 30 TO 58 (INCLUDING COMPARATIVE)

Various other nonorganic salts were used.

TABLE 2

| Example | salt (amount g/l) | % WBF | dSS | Foaming 1 min | 3 min | 5 min | 10 min |
|---|---|---|---|---|---|---|---|
| C-30 | sodium carbonate 4 | 83.1 | −20 | 2.5 | 5.1 | 7.0 | (a) |
| C-31 | sodium carbonate 4 | 83.2 | −19 | 1.3 | 2.5 | 7.9 | 3.4 |
| C-32 | sodium carbonate 12 | 96.3 | −15 | .7 | 1.5 | 1.9 | 2.1 |
| C-33 | sodium carbonate 12 | 93.4 | −10 | .1 | .1 | .1 | .1 |
| C-34 | sodium hexametaphosphate 4 | 80.0 | −3 | .8 | 1.5 | 2.0 | 2.3 |
| 35 | sodium hexametaphosphate 4 | 88.0 | 0 | 4.7 | (b) | | |
| 36 | sodium hexametaphosphate 12 | 80.2 | +2 | 1.5 | 2.7 | 3.5 | 4.3 |
| 37 | sodium hexametaphosphate 12 | 86.5 | +4 | 3.4 | (c) | | |
| C-38 | sodium nitrate 4 | 84.3 | −36 | 1.7 | 3.5 | 4.5 | 5.7 |
| C-39 | sodium nitrate 4 | 89.2 | −41 | 3.8 | (b) | | |

TABLE 2-continued

| Example | salt (amount g/l) | % WBF | dSS | Foaming 1 min | 3 min | 5 min | 10 min |
|---|---|---|---|---|---|---|---|
| C-40 | sodium nitrate 12 | 60.2 | −41 | 3.5 | 7.1 | (d) | |
| C-41 | sodium nitrate 12 | 78.7 | −44 | .7 | 1.3 | 1.9 | 2.1 |
| C-42 | sodium sulfate 4 | 57.9 | −25 | 1.7 | 3.5 | 4.7 | 6.4 |
| C-43 | sodium sulfate 4 | 72.8 | −25 | 3.5 | 1.2 | (e) | |
| C-44 | sodium sulfate 12 | 58.6 | −26 | 2.5 | 5.6 | (f) | |
| C-45 | sodium sulfate 12 | 73.2 | −35 | .2 | .2 | .2 | .1 |
| 46 | tetrasodium pyrophosphate 4 | 90.3 | +7 | 1.3 | 2.5 | 3.2 | 4.0 |
| 47 | tetrasodium pyrophosphate 4 | 97.1 | +12 | 4.5 | (g) | | |
| 48 | tetrasodium pyrophosphate 12 | 94.0 | +11 | 2.6 | 6.9 | (h) | |
| 50 | tetrasodium pyrophosphate 12 | 96.8 | +14 | .2 | .2 | .2 | .2 |
| C-51 | trisodium phosphate 4 | 97.1 | −17 | 2.1 | 4.9 | 6.8 | (i) |
| C-52 | trisodium phosphate 4 | 92.3 | −23 | 2.8 | 4.3 | 5.1 | 5.9 |
| 53 | trisodium phosphate 12 | 97.3 | +5 | 2.1 | 2.8 | 3.9 | 4.5 |
| 54 | trisodium phosphate 12 | 96.1 | 0 | .1 | .1 | .1 | .1 |
| C-55 | sodium aluminate 4 | 64.3 | −21 | .5 | 1.1 | 1.5 | 2.3 |
| C-56 | sodium aluminate 4 | 47.0 | −26 | 1.6 | 2.9 | 3.9 | 6.4 |
| C-57 | sodium aluminate 12 | 55.4 | −20 | .5 | 1.1 | 1.1 | 1.9 |
| C-58 | sodium aluminate 12 | 79.9 | −11 | .2 | .3 | .3 | .3 |

(a) over top at 6 min
(b) over top at 2 min
(c) over top at 2.25 min
(d) over top at 3.25 min
(e) over top at 4 min
(f) over top at 5 min.
(g) over top at 3 min
(h) over top at 3.5 min
(i) over top at 9 min.

EVALUATION OF TEST RESULTS

As will be seen from Table 1, all examples according to this invention (nos. 8–29) showed excellent to acceptable stain test results, whereas all examples without any inorganic phosphate salts (C-1 to C-7) showed severe staining. Furthermore, as can be seen by comparing the % WBF for a given amount of surfactant, the results are always better when the inorganic phosphate salt is included for example, taking the best result for the absence of the inorganic phosphate salt (Ex. C-5) in which the surfactant is present in 8.75 g/l, and comparing this result with Examples 12 and 20, it can be seen that the results according to this invention are always superior. In fact, the compositions according to this invention may employ less surfactant, replacing it partially with the lower cost inorganic phosphate salt, which is a great advantage. An interesting observation is that excessive foaming without the inorganic phosphate salt starts at a surfactant level of 6.25 (Ex. C-3) and continues through a level of 8.75 (Ex. C-5). In striking and desireable contrast, the excessive foaming with the inorganic salt is of a much shorter range, as indicated in Examples 10, 18, 23, and 27, and occurs at much lower surfactant levels. This permits the addition of larger amounts of surfactants (when the inorganic phosphate salts are present) to overcome specific production problems which may occur. Particularly striking is that Ex. 29, which used no surfactant at all, achieved a satisfactory % WBF and dSS. Thus, the surfactant may be eliminated entirely, although then it is preferred that it be used in 1 to 3 g/l quantities.

Table 2 demonstrates that only some inorganic salts are useful for this invention. All of the salts in Table 2 were chosen because they were thought likely to be effective. However, as can be seen, those labeled comparative examples (sodium carbonate, sodium nitrate, sodium sulfate, and sodium aluminate) produced severe staining. Marginally acceptable salts include trisodium phosphate (which is acceptable in larger amounts), and sodium hexametaphosphate (which gave mixed results at lower amounts). Clearly, the tetrasodium pyrophosphate produced excellent staining results, and is less preferred than the sodium tripolyphosphate only because the latter is more soluble. It should be noted that the salts in the comparative examples were all satisfactory in the foaming tests, and it may therefore be possible to employ them in admixture with the salts according to this invention, especially where such admixtures are cost effective.

It is of course, known in the art that the initial make-up cleaner composition has all ingredients in the desired quantities, but that these ingredients are consumed in differing proportions. Thus, when the cleaner solution is replenished, the ingredients are added in proportions different from the initial solution, so that the initial ingredient proportions are maintained.

All of the above examples are directed to showing that using the compositions of this invention will avoid the serious problem of staining caused when the can cleaning production line is stopped while the cans are in contact with the cleaning solution. The following examples demonstrate that the cleaning composition of this invention also produces superior cleaning results.

CLEANING EXAMPLES

In order to demonstrate that the inventive alkaline aluminum-cleaning composition not only avoided problems but also cleaned aluminum cans satisfactorily, the compositions disclosed in Table 3, below, were prepared and used to clean aluminum can blanks. The prewash was at a temperature of 120° F. (49° C.) for 30 seconds, followed by a wash with the following compositions at 120° F. (49° C.) for 35 seconds, and then by a rinse with deionized water at ambient temperature. All ingredients below are in g/l.

TABLE 3

| Example | TPP | EDTA Na Salt | NTA Na Salt | seq. agnt. | surf. | NaOH present | pH | Reflectivity interior | Reflectivity exterior | % WBF |
|---|---|---|---|---|---|---|---|---|---|---|
| C-59 | 4 | 8 | — | 1 | 1 | no | 10.75 | 201 | 356 | 98.4 |
| 60 | 4 | 2.5 | — | 1 | 1 | yes | 12.0 | 245 | 369 | 99.7 |
| 61 | 4 | — | 1.65 | 1 | 1 | yes | 12.0 | 240 | 369 | 99.4 |

In comparative example C-59 the pH was below the minimum of 11 required according to the invention. As a result, the interior reflectivity value was too low, indicating that the can was not clean enough. The base line reflectivity values were 169 for interior and 329 for exterior. At an interior reflectivity of above 235, there was no visible signs of fines, indicating that the can was acceptably clean. The interior reflectivity of example C-59 was completely unacceptable. The particular can blanks tested were obtained from National Can Co., Piscataway, N.J., U.S.A. It should be noted that the acceptable interior reflectivity value will vary for each type of can configuration, each type of production equipment, ambient water, cleaning conditions, and the like. Therefore this value should be taken only as a comparative for identical cans tested under identical conditions. The exterior reflectivity values were acceptable for all three examples. The secondary sequestrant (seq.) used was sorbitol. The surfactant (surf.) used was a combination of A and C in a weight ratio A:C of 3.5. Although the pH in example C-59 was too low with the use of 8 g/l of EDTA Na salt, this amount may be enough where the ambient water has a sufficiently high pH to result in a cleaning bath pH of at least 11. The EDTA Na salt and NTA Na salt were each present in the equimolar amount of 0.006 mols. As can be seen, both of these salts gave acceptable results.

We claim:

1. In an aqueous alkaline cleaning composition bath for removing and dissolving aluminum fines and lubricating oils from formed aluminum surfaces, said bath having a water base, a pH of at least 11, and ingredients consisting essentially of:

(a) an alkali metal salt of ethylenediaminetetraacetic acid, an alkali metal salt of nitrilotriacetic acid, or their mixture, present in the bath in about 0.1 to about 8.0 g/l;

(b) at least one surfactant, present in the bath in about 0.1 to about 10 g/l; and (c) at least one alkali metal hydroxide present in the bath in an amount sufficient to adjust the pH to at least 11; the improvement consisting of (d) at least one inorganic alkali metal phosphate, present in the bath in about 0.1 to 20 g/l.

2. The bath of claim 1 adjusted to a pH of from 11 to about 12.5.

3. The bath of claim 1 adjusted to a pH of about 11.5 to about 12.3.

4. The bath of claim 1 wherein (a) is a sodium salt and is present in the bath in about 0.3 to about 5.0 g/l.

5. The bath of claim 1 wherein (a) is sodium salt and is present in the bath in about 1.5 to 3.0 g/l.

6. The bath of claim 1 wherein (b) is at least one anionic, cationic or nonionic surfactant and is present in the bath in about 0.2 to about 3.0 g/l.

7. The bath of claim 1 wherein (d) is at least one of: sodium tripolyphosphate, sodium pyrophosphate, sodium hexametaphosphate, trisodium phosphate, sodium phosphate monobasic, sodium phosphate dibasic, or a corresponding potassium or lithium salt; and is present in the bath in about 2.0 to about 10.0 g/l.

8. The bath of claim 1 wherein (d) is at least one of: sodium tripolyphosphate, sodium pyrophosphate, sodium hexametaphosphate, trisodium phosphate, sodium phosphate monobasic, sodium phosphate dibasic, or a corresponding potassium or lithium salt; and is present in the bath in about 4.0 to about 8.0 g/l.

9. The bath of claim 1 wherein (c) is NaOH, KOH, or a mixture thereof, and is present in the bath in up to about 5.0 g/l.

10. The bath of claim 1 wherein:

(a) is a sodium salt and is present in the bath in about 0.3 to about 5.0 g/l;

(b) is at least one anionic, cationic or nonionic surfactant and is present in the bath in about 0.2 to about 3.0 g/l;

(c) is NaOH, KOH, or a mixture thereof, and is present in the bath in up to about 5.0 g/l; and (d) is at least one of sodium tripolyphosphate, sodium pyrophosphate, sodium hexametaphosphate, trisodium phosphate, sodium phosphate monobasic, sodium phosphate dibasic, or a corresponding potassium or lithium salt, and is present in the bath in about 2.0 to about 10.0 g/l.

11. The bath of claim 3 wherein:

(a) is a sodium salt and is present in the bath in about 1.5 to 3.0 g/l;

(b) is at least one anionic, cationic or nonionic surfactant and is present in the bath in about 0.2 to about 3.0 g/l;

(c) is NaOH, KOH, or a mixture thereof, and is present in the bath in up to about 5.0 g/l; and (d) is at least one of sodium tripolyphosphate, sodium pyrophosphate, sodium hexametaphosphate, trisodium phosphate, sodium phosphate monobasic, sodium phosphate dibasic, or a corresponding potassium or lithium salt, and is present in the bath in about 4.0 to about 8.0 g/l.

12. The bath of claim 1 wherein (a) is sodium ethylenediaminetetraacetate.

13. The bath of claim 1 wherein (a) is sodium nitrilotriacetate.

14. A concentrate for preparing an aqueous alkaline cleaning composition bath for removing and dissolving aluminum fines and lubricating oils from formed aluminum surfaces consisting essentially of the ingredients of claim 1, each present in an amount in parts by weight numerically equal to said respective grams per liter.

15. A concentrate for preparing an aqueous alkaline cleaning composition bath for removing and dissolving aluminum fines and lubricating oils from formed aluminum surfaces consisting essentially of the ingredients of claim 10, each present in an amount in parts by weight numerically equal to said respective grams per liter.

16. A concentrate for preparing an aqueous alkaline cleaning composition bath for removing and dissolving aluminum fines and lubricating oils from formed aluminum surfaces consisting essentially of the ingredients of claim 11, each present in an amount in parts by weight numerically equal to said respective grams per liter.

17. A method for removing and dissolving aluminum fines and lubricating oils from formed metal surfaces comprising contacting said surfaces with a removing and dissolving effective amount of the composition bath of claim 1.

18. The method of claim 17 wherein said contacting is for a time of about 10 to about 120 seconds and said bath is at a temperature of about 27° C. to about 66° C.

19. The method of claim 17 wherein said contacting is by immersing said surface in said bath for a time of about 10 seconds to about 60 seconds while maintaining said bath at a temperature of about 32° C. to about 60° C.

20. The method of claim 17 wherein said contacting is by spraying said surface with said bath for a time of about 10 seconds to about 60 seconds while maintaining said bath at a temperature of about 32° C. to about 60° C.

* * * * *